US005219069A

United States Patent [19]

Sonnek

[11] Patent Number: 5,219,069

[45] Date of Patent: Jun. 15, 1993

[54] CHAINABLE PLASTIC COIN HOLDER

[76] Inventor: Tom F. Sonnek, 12205 N. Vega Ave., Mequon, Wis. 53092

[21] Appl. No.: 938,965

[22] Filed: Sep. 1, 1992

[51] Int. Cl.[5] ..... B65D 85/58

[52] U.S. Cl. ..... 206/0.83; 63/3; 63/23; 206/0.84; 224/220

[58] Field of Search ..... 63/1.1, 2, 3, 21, 23; 206/0.8, 0.81, 0.82-0.84, 445; 224/165, 173, 178, 219-221

[56] References Cited

U.S. PATENT DOCUMENTS

| | | | |
|---|---|---|---|
| 334,844 | 1/1886 | Briessen | 224/221 |
| 1,115,136 | 10/1914 | Wallerstedt | 224/221 |
| 3,139,977 | 7/1964 | Burdick | 206/0.83 |
| 3,141,546 | 7/1964 | Leopoldi | 206/0.81 |
| 3,330,057 | 7/1967 | Rodgers . | |
| 3,670,524 | 6/1972 | Korwin | 63/23 |
| 3,754,285 | 8/1973 | Greene | 2/336 |
| 3,964,187 | 6/1976 | Stumpf . | |
| 4,043,477 | 8/1977 | Deese | 206/0.83 |
| 4,091,639 | 5/1978 | Benda | 63/18 |
| 4,377,939 | 3/1983 | Reinsdorf | 63/2 |
| 4,399,910 | 8/1983 | Gutentag | 206/0.82 |
| 4,970,878 | 11/1990 | Lee | 63/23 |

*Primary Examiner*—Jimmy G. Foster
*Attorney, Agent, or Firm*—Wheeler Law Firm

[57] ABSTRACT

A coin holder made of plastic, or another suitably flexible material, having a flexible base, a flexible wall extending at a right angle from the base, a T-shaped tab extending outwardly from the base, and one or more tab-receiving slots in the base. The base and wall form a recess into which a coin may be fitted. The slots accept the T-shaped tab of another coin holder at an angle, and lock the coin holders together when the angle is reduced. In addition, the invention includes a flexible band into which coin holders may be attached for holding and display by being anchored parallel to the flexible band, or hanging freely from the flexible band.

9 Claims, 1 Drawing Sheet

CHAINABLE PLASTIC COIN HOLDER

BACKGROUND OF THE INVENTION

The present invention relates to the field of coin holders. Specifically it relates to coin holders that may be connected together to form a chain or other structure.

It is a custom at Mardi Gras parades for persons on floats to throw Mardi Gras coins to a parade crowd. Parade goers collect the coins. It is an objective of the present invention to provide a device that will not only hold these coins and coins like these for display but that will also allow the interconnection of a number of holders to form display patterns whose diversity is limited only by the imagination of the collector.

Although many references to coin holders are known, none are known to the inventor which have or combine the unique features of this coin holder. For instance, U.S. Pat. No. 3,139,977 (Burdick) discloses a fully enclosed protective coin cover, and a magnifying structure which allows for closer inspection of the held coin. Burdick discloses no tabs or method for interconnection of holders. A main feature of the present invention is such an interconnection of holders.

U.S. Pat. Nos. 3,964,187 (Stumpf), 4,091,639 (Benda) and 4,970,878 (Lee) all disclose coin holders. None, however, disclose any tabs or method of interconnection of holders. As mentioned above, a main feature of the present invention is the interconnection of multiple holders.

U.S. Pat. No. 3,330,057 (Rodgers) shows a wrist band to hold an identification badge. The identification badge must be specially shaped in order to mount to the wrist band. The present invention requires no special addition to a coin in order for the coin to be held. The present invention will be able to hold coins having a diameter of approximately the same size as the diameter of an annular ring of predetermined size. In order to accommodate different coin sizes, different size diameter holders may be used. Rodgers shows no method for interconnecting numerous badges. As stated above, such interconnection is a main feature of the present invention.

U.S. Pat. No. 3,141,546 (Leopoldi) teaches a closed coin and key holder. Leopoldi provides no display of coins. Its main objective is as a means for carrying parking meter coins. A main objective of the present invention is to display coins. As in the above named patents, Leopoldi discloses no method or means for interconnection of holders.

U.S. Pat. No. 3,754,285 (Greene) teaches a belt link with extending T-shaped tabs at one end and slots for receiving the T-shaped tabs at the other end. The T-shaped tabs in Greene allow connection of belt links in a straight line to form a belt. Greene does not hold coins. The central display area has a permanently mounted pattern. No receptable for attaching anything is provided in Greene. In addition, the Greene device may only be connected in a straight line. The present invention, however, may be connected in any number of patterns, because of the alternate slot receptacles for T-shaped tabs of other such holders. Greene provides no way of interchanging different designs on a belt. The present invention does allow for the interchanging of coins, since the coins are not permanently mounted to the coin holder.

SUMMARY OF THE INVENTION

The present invention is a coin holder to be used to hold and display coins. Specifically the holding and display of commemorative Mardi Gras coins is envisioned.

The coin holder is created by molding or otherwise forming plastic or another suitably flexible material into a single unit. The single unit has a flexible circular base with a flexible wall around the circumference of the base, and at substantially a right angle to the base. In addition, the unit has a T-shaped tab extending outwardly from the base. This T-shaped tab is used as one half of an interlocking system that allows connection of more than one coin holder to form a chain of coin holders. The base of the coin holder has, spaced around its circumference, one or more tab receiving slots. The T-shaped tabs of other coin holders fit into these slots when the T-shaped tabs are inserted into a slot at a substantial angle to the flexible base. When the T-shaped tab is rotated so that it is substantially parallel to the flexible base, the ends of the T-shaped tab extend wider than the slot, and lock the two holders together. When a coin is placed into the holder, it forces the T-shaped tab and the base to remain nearly parallel, preventing disengagement of the two holders. One of these slots is diametrically opposed to the T-shaped tab.

The base of the holder has an opening. The opening serves two purposes. First, the opening serves to relieve air pressure when placing a coin into the holder. Second, the opening serves as a finger hole for pushing the coin out of the holder when desired.

Another element of the present invention is a band made of plastic or another similar flexible material that contains slots designed to receive the T-shaped tabs of a coin holder. In this embodiment the coin holder would dangle from the band. In addition, the band could contain additional sockets for detachably mounting a coin holder parallel to the band. The sockets have a circular opening in the band that is spaced at a preset distance from the T-shaped tab, as mentioned above, to allow the connection. The number of different combinations of coin holders is limited only by the imagination of the coin collector.

These and other benefits of the present invention will become apparent from the following detailed description thereof taken in conjunction with accompanying drawings.

DETAILED DESCRIPTION

Figure 1:
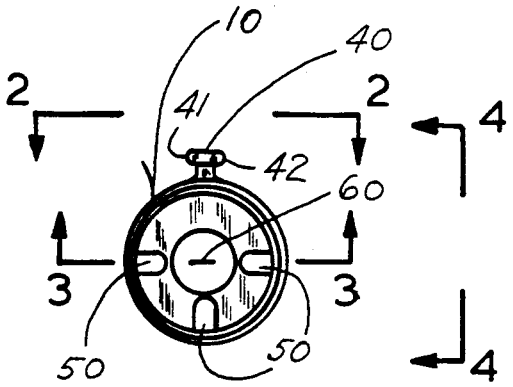
FIG. 1 is a top view of the coin holder.
Figure 2:
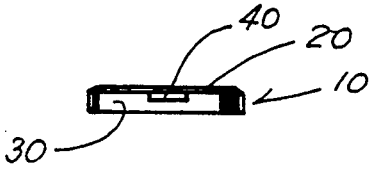
FIG. 2 is a side view of the coin holder from line 2—2 of FIG. 1.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Referring to FIGS. 1–4, the coin holder 10 may be seen. The coin holder 10 comprises a flexible circular base 20, a flexible wall 30 surrounding the circumference of the base 20, at a right angle to the base 20, a T-shaped tab 40 having a first end 41 and a second end 42, the T-shaped tab 40 extending outwardly from the base 20, at least one tab-receiving slot 50, and an opening 60 adapted to alleviate air pressure when a coin is placed in the holder 10 and to facilitate removal of a coin from the coin holder 10.

The coin holder 10 is preferably constructed with molded plastic. Any other suitably flexible material will also work.

The tab receiving slots 50 are designed to accept the T-shaped tab 40 of another coin holder 10, when the T-shaped tab 40 is positioned at a substantial angle to the flexible base 20. When the T-shaped tab 40 is then rotated so that it is substantially parallel to the flexible base 20 of the coin holder 10 to which it is being attached, the ends 41 and 42 of the T-shaped tab 40 extend wider than the tab receiving slot 50. The two coin holders 10 are then detachably coupled, and will remain coupled as long as the T-shaped tab 40 of the first coin holder 10 remains substantially parallel to the base 20 of the second coin holder 10. When a coin is placed into the coin holder 10, the coin forces the T-shaped tab 40 and the flexible base 20 of the two coin holders 10 to remain nearly parallel. A number of coin holders 10 may be coupled together in this manner to create a chain of coin holders 10.

Figure 3:
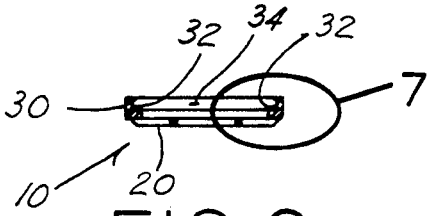
FIG. 3 is a cut away view of the coin holder from line 3—3 of FIG. 1.
Figure 4:
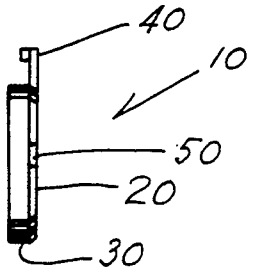
FIG. 4 is a side view of the coin holder from line 4—4 of FIG. 1.

The diameter of the flexible base 20 is such that the flexible wall 30 and the flexible base 20 create a recess 34 in the coin holder 10 which is a close fit in size to a Mardi Gras coin or other coin or medallion. The flexible base 20 and flexible wall 30 could be sized to fit any coin. Referring to FIGS. 1 and 3, and also to FIG. 7, it may be seen that the coin holder 10 has an opening 60 in the center of the base 20. The opening 60 serves to allow easy removal of a coin from the coin holder 10 by simply pushing a finger through the opening 60. The opening 60 also serves to prevent the buildup of air pressure when placing a coin into the coin holder 10.

Figure 7:
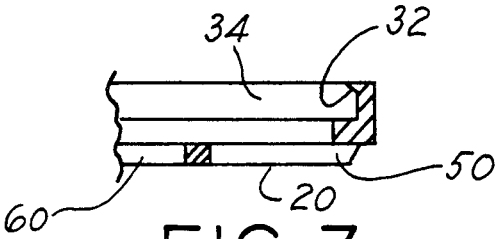
FIG. 7 is a detailed close up of one section of the coin holder as indicated in FIG. 3.

The flexible wall 30 may be seen in FIG. 7 to have a lip 32 located on the top inside 31 of the flexible wall 30. The diameter of the area defined by the lip 32 is slightly smaller than the diameter of the recess 34 and slightly smaller than the diameter of the Mardi Gras coin, in order to keep the coin from falling out of the coin holder 10 when it is in place.

Figure 5:
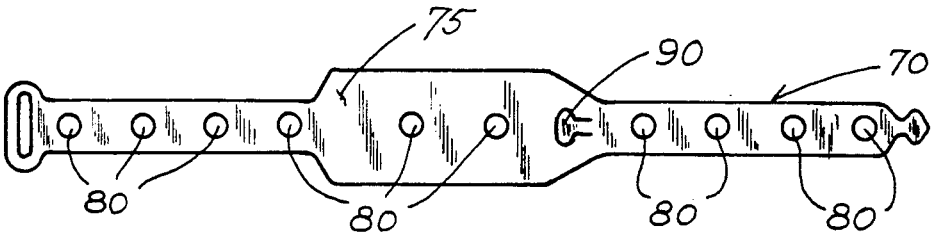
FIG. 5 is a top view of the flexible band.
Figure 6:
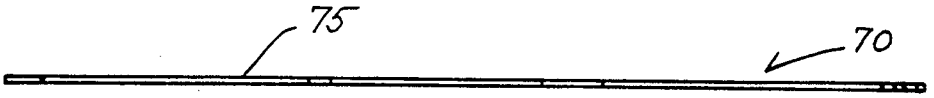
FIG. 6 is a side view of the flexible band.

Referring to FIG. 5, a flexible band 70 for holding and display of coin holders 10 may be seen. The flexible band 70 contains a number of circular sockets 80. The sockets 80 act in substantially the same capacity as the tab-receiving slots 50 in the coin holder 10. When a T-shaped tab 40 of a coin holder 10 is oriented at a substantial angle to the surface 75 of the flexible band 70, the sockets 80 will receive the T-shaped tab 40. When the coin holder 10 is allowed to dangle from the flexible band 70, the circular shape of the sockets 80 will retain the T-shaped tab 40 in the flexible band 70 since the ends 41 and 42 of the T-shaped tab 40 extend beyond the width of the sockets 80. Additionally, the flexible band 70 contains at least one T-shaped band tab 90 and at least one band slot 91 which have generally the same structure as the T-shaped tabs 40 and the tab-receiving slots 50 of the coin holder 10. This T-shaped band tab 90 in combination with a socket 80 spaced at an interval that is approximately equal to the diameter of the flexible base 20 of a coin holder 10 will allow the coin holder 10 to be mounted on the flexible band 70 parallel to the band surface 75.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A plurality of interconnectable coin holders each comprising:

a flexible body having a flexible base and a flexible wall with an inside surface having a top, said flexible wall sized to closely fit a pre-determined coin and surrounding the circumference of said flexible base at substantially a right angle to said flexible base;

a T-shaped tab extending outwardly from said flexible base;

said flexible body having a tab-receiving slot shaped to receive a T-shaped tab of one of the plurality of interconnectable coin holders in an orientation at a substantial angle to said flexible base having said tab-receiving slot;

said flexible body being movable to an orientation in which a said T-shaped tab of a different coin holder lies parallel to said flexible base;

a coin being insertable in said flexible wall to secure said T-shaped tab against movement.

2. The coin holder of claim 1 wherein each said tab-receiving slot is diametrically opposed to a said T-shaped tab.

3. The coin holder of claim 1 further comprising a plurality of slots in each said base spaced at intervals around said flexible base.

4. The coin holder of claim 1 further comprising a flexible band;

said flexible band having at least one band slot for receiving a said T-shaped tab and at least one T-shaped band tab for engaging said tab-receiving slot;

said band slot being engaged with said T-shaped tab, and said T-shaped band tab being engaged with said tab receiving slot;

whereby said coin holder is anchored parallel to said flexible band.

5. The coin holder of claim 4 wherein said flexible band has a socket;

said socket having means to engage said T-shaped tab of said coin holder; whereby said coin holder hangs freely from said flexible band.

6. The coin holder of claim 5 wherein said socket is a circular opening in said flexible band.

7. The coin holder of claim 1 wherein said flexible base has an opening; whereby air may reach a coin in said holder and allow a user to push a coin from said holder.

8. The coin holder of claim 1 wherein said flexible wall has a lip extending inwardly from said top inside surface of said flexible wall.

9. A coin holder comprising:

a flexible body having a flexible base shaped like a circular coin and a flexible wall with an inside surface having a top, said flexible wall surrounding the circumference of said base at a right angle to said base;

a T-shaped tab;

said T-shaped tab connected to and extending outwardly from said flexible base;

said flexible body having at least one tab-receiving slot;

said flexible wall having a lip extending inwardly from said top inside surface;

a flexible band;

said flexible band having at least one band slot and at least one T-shaped band tab;

said band slot being engaged with said T-shaped tab, and said T-shaped band tab being engaged with said tab-receiving slot;

said band having at least one socket;

said flexible base having an opening adapted to permit air to reach a coin in said holder and to allow a user to push a coin from said holder.

* * * * *